United States Patent [19]

Jansen

[11] Patent Number: 4,940,004

[45] Date of Patent: Jul. 10, 1990

[54] HIGH ENERGY COMBUSTION AIR NOZZLE AND METHOD FOR IMPROVING COMBUSTION IN CHEMICAL RECOVERY BOILERS

[75] Inventor: Johan H. Jansen, Bellevue, Wash.

[73] Assignee: J. H. Jansen Company, Inc., Woodinville, Wash.

[21] Appl. No.: 376,824

[22] Filed: Jul. 7, 1989

[51] Int. Cl.[5] ..... F23L 5/00

[52] U.S. Cl. ..... 110/182.5; 122/6.5; 122/6.6

[58] Field of Search ..... 110/297, 309, 310, 182.5; 431/190; 122/6 A, 6.5, 6.6

[56] References Cited

U.S. PATENT DOCUMENTS

| | | | |
|---|---|---|---|
| 769,872 | 9/1904 | Ochwat . | |
| 1,849,279 | 3/1932 | Cezanne . | |
| 3,190,245 | 6/1965 | Huntington | 110/309 |
| 3,403,642 | 10/1968 | Parkin | 110/7 |
| 3,607,117 | 9/1971 | Shaw et al. | 23/277 |
| 3,625,186 | 12/1971 | Herbet | 122/7 |
| 3,742,916 | 7/1973 | Wessberg et al. | 110/182.5 |
| 3,877,440 | 4/1975 | Winkin | 110/309 |
| 3,943,861 | 3/1976 | Åström et al. | 110/182.5 |
| 4,027,604 | 6/1977 | Jansson | 122/6.5 |
| 4,099,471 | 7/1978 | Sander et al. | 110/182.5 |
| 4,336,131 | 6/1982 | Schmidt et al. | 209/3 |
| 4,347,220 | 8/1982 | Nelson et al. | 422/185 |
| 4,359,950 | 11/1982 | Leffler et al. | 110/188 |
| 4,362,269 | 12/1982 | Rastogi et al. | 236/14 |
| 4,480,558 | 11/1984 | Russell | 110/310 |
| 4,538,552 | 9/1985 | Smuda | 122/387 |
| 4,545,308 | 10/1985 | Zaterka | 110/297 |
| 4,683,841 | 8/1987 | Andersson et al. | 122/22 |
| 4,768,469 | 9/1988 | Ilzuka et al. | 122/448 R |
| 4,838,182 | 6/1989 | Goodspeed | 110/182.5 |
| 4,846,080 | 7/1989 | Ross et al. | 110/182.5 |

*Primary Examiner*—Henry A. Bennet
*Assistant Examiner*—Denise L. Ferensic
*Attorney, Agent, or Firm*—Bruce A. Kaser

[57] ABSTRACT

Recovery boiler wind boxes are upgraded by providing an air nozzle and damper installation where the nozzle crosses through the inside of the wind box. Air is channeled from the box into the nozzle by the damper. The nozzle is convergent and jets air into the boiler's combustion chamber. The typical boiler has a plurality of combustion air ports leading into the chamber. Modifying each air port by using the nozzle and damper installation creates a surrounding arrangement of air jets about the chamber which creates turbulent mixing in the boiler's furnace gases.

10 Claims, 9 Drawing Sheets

HIGH ENERGY COMBUSTION AIR NOZZLE AND METHOD FOR IMPROVING COMBUSTION IN CHEMICAL RECOVERY BOILERS

TECHNICAL FIELD

The present invention generally relates to black liquor recovery boilers and the like, and in particular, to air ports or nozzles which deliver combustion air into a recovery boiler's furnace.

BACKGROUND INFORMATION

A person having familiarity with black liquor recovery boilers would know that they are necessary parts of the pulp production process and are used in pulp mills for liquor disposal, steam generation and recovery of chemical products through a combustion process. The production of a pulp mill is integrally linked to its recovery boiler's liquor firing and steam generating capacity.

In recent times, pulp mills have been gradually increasing their level of production. This has been occurring primarily as a result of better process management and more efficient use of existing machinery.

These improvements have come about in the form of upgrades in existing mills. When these mills were originally built, for example, they were built with recovery boilers that were adequate to meet mill capacity at that time. However, mill upgrades are now pushing recovery boiler use requirements beyond their original design capacity. As a result, recovery boilers are now limiting and creating a major restriction in pulp mill output.

The solution to this problem is for mills to either build one or more additional recovery boilers, or modify their existing boilers. The former is certainly technically feasible although it is expensive and therefore represents an economic detriment. The latter has not always been technically or economically feasible. The economics of pulp making is dictating a need to develop cost-effective ways of upgrading the capacity of existing boilers and this is the underlying reason leading to the development of the present invention.

The main objective in recovery boilers is to dispose of a process waste material (black liquor) by burning the organic residue, thereby generating steam, and converting the inorganic chemicals to a reusable form. This is to be done while at the same time minimizing the carry-over of particulate matter and release of environmentally-objectionable gases through the boiler's stack. There have been many attempts in the past to improve boiler efficiency by implementing complex control systems that affect airflow rate into the combustion chamber. Notable examples of this are shown in U.S. Pat. No. 4,362,269 issued to Rastogi on Dec. 7, 1982, and U.S. Pat. No. 4,359,950 issued to Leffler on Nov. 23, 1982.

Both patents provide a good description of recovery boiler operation and recognize that boiler efficiency is affected by the control of air into the combustion chamber. Nevertheless, both are primarily concerned with the chemical efficiency of the combustion process which, of course, is also a concern in the present invention. However, neither patent is concerned with increasing boiler capacity in the same way as the present invention or, in other words, neither provides combustion air in the same way as the present invention.

A significant difference between the present invention and the known prior art is that the prior art does not force a penetrating airflow into the furnace in the central part of the boiler above the burning bed. This is the crux of the invention disclosed herein, and it creates turbulent mixing with the furnace gases above the bed, which significantly improves boiler combustion efficiency and capacity.

SUMMARY OF THE INVENTION

The invention disclosed herein provides an apparatus and a method for modifying and improving the capacity of existing recovery boilers. Most modern-day recovery boilers have three levels where air, usually called "combustion air," is input to the boiler's furnace or combustion chamber. The lowest or primary level is at or near the same level as the burning bed. The mid or secondary level is positioned just above where the top of the burning bed would normally be located if the boiler were operating at optimum design capacity. The upper or tertiary level is located above the normal position where fuel guns deliver black liquor fuel into the combustion chamber. Some, but not all, older recovery boilers employ only two levels of combustion air, e.g. primary and secondary, with the secondary being high above the fuel guns.

Combustion air is delivered at the secondary and tertiary levels by wind boxes which are essentially large, box-like ducts that are mounted to and surround the outside wall of the combustion chamber. These ducts operate as manifolds and feed air directly into the combustion chamber through a number of ports in the chamber's walls.

In the past, combustion air exiting secondary or tertiary wind boxes into the combustion chamber did not have sufficient velocity or momentum to mix with upwardly-exiting furnace gases. In fact, poor penetration of combustion air tends to channel high temperature gases into the center of the furnace (a stack pattern), resulting in inefficient combustion of materials, poorer liquor recovery, high level of chemical carry-over, higher TRS/CO emissions and higher furnace flue gas exit temperatures. All of these things are undesirable in a black liquor recovery boiler, as they reduce the unit's capacity.

Essentially, a wind box is a large box having a plurality of openings or ports in a furnace wall leading into the boiler's combustion chamber. Pressurized airflow is provided to the wind boxes by a fan and each wind box consequently functions as a plenum. The present invention resides in transition hardware from the wind box through the furnace wall, with such hardware providing a convergent nozzle installation for each port.

In one embodiment, the invention is installed by first making an upper and lower cut-out in the outer wall of the wind box opposite an individual air port or opening in the furnace wall. Then, a convergent nozzle is installed through one cut-out and extends across the wind box from the cut-out to the furnace wall opening. Its outlet end is connected to the port in a manner so that combustion air is delivered directly from the nozzle into the combustion chamber, and its inlet end is sized to approximately correspond to the shape or perimeter of the wind box cut-out. The nozzle is installed in a manner so that there is no airflow directly from inside the wind box to the convergent nozzle. Instead, a damper section is installed over both cut-outs, i.e. the one through which the nozzle was installed, and the other one which leads directly into the wind box, and thus channels air from inside the wind box around through a flow-straightening section of the damper section, and back into the nozzle. Thus, the transition hardware making up this embodiment includes a convergent nozzle and damper section installation.

The convergence of the nozzle increases the speed, and consequently, the momentum of the air as it exits the furnace wall opening into the combustion chamber. A separate installation of this kind is made for each combustion air port at the boiler's secondary and tertiary combustion air levels so that penetrating air may be jetted into the furnace gases and create turbulent mixing above the combustion chamber's burning bed. This significantly improves the efficiency of the combustion process.

As indicated above, recovery boilers vary in design, which means their combustion air feed systems can also vary. The embodiment of the invention summarized above is suitable for modifying or upgrading the combustion air feed systems of certain kinds of recovery boilers. In other boilers, however, another embodiment of the invention is required. This embodiment is installed by first building a secondary wind box inside the structure of a preexisting wind box. Then, a convergent nozzle is installed inside the preexisting wind box, but is connected directly to the newly-constructed secondary wind box by a damper duct. A booster fan is used to supply high pressure air into the secondary wind box which is communicated via the damper duct into the convergent nozzle. As with the first embodiment discussed above, the nozzle of the second embodiment has an outlet end which is connected to an air port or opening leading into the boiler's furnace. The transition hardware making up this second embodiment therefore includes the same kind of convergent nozzle, but an alternative way of feeding air into the nozzle. That is, a secondary wind box installation with a damper duct connecting the secondary wind box to the nozzle. Like the first embodiment discussed above, the convergence of the nozzle in the second embodiment similarly increases the speed and momentum of the air as it exits the port into the furnace, and therefore provides the same benefits The advantages and features of the invention will become better understood to the reader upon consideration of the following description when taken in conjunction with the drawings.

BRIEF DESCRIPTION OF THE DRAWING

In the various figures appended hereto, like reference numerals and letters refer to like parts throughout the various views except where otherwise indicated, and wherein.

BEST MODE FOR CARRYING OUT THE INVENTION

Figure 1:
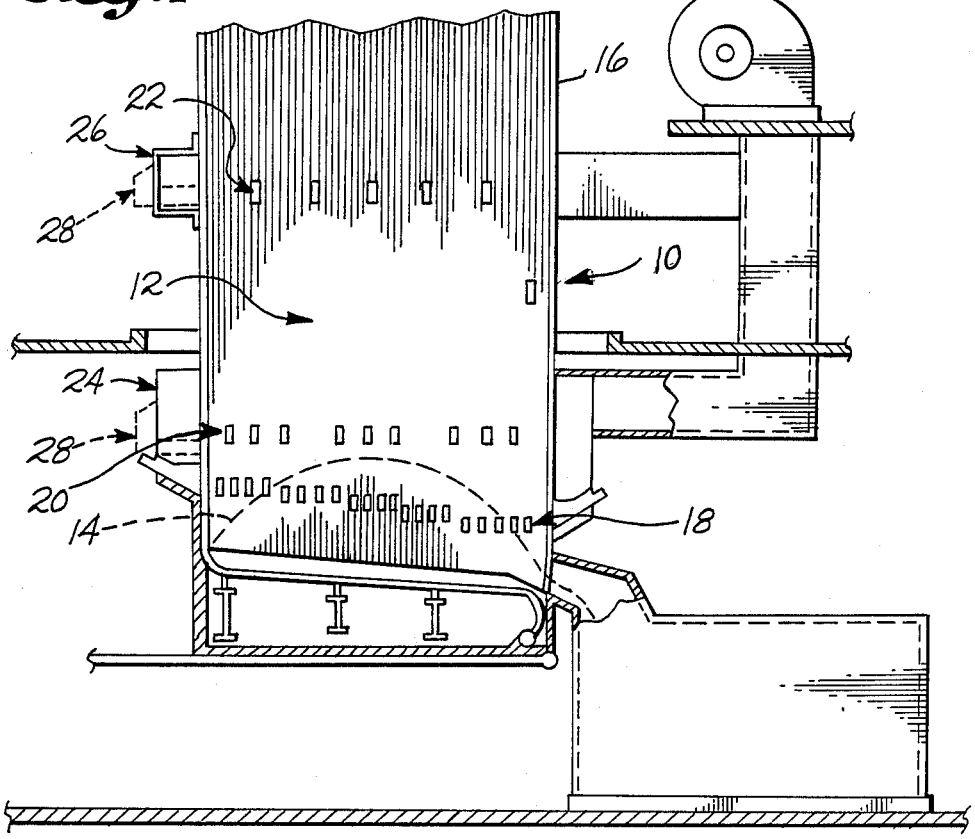
FIG. 1 is a side cross-sectional view of the lower position of a conventional recovery boiler and shows the boiler's furnace or combustion chamber and how the present invention is implemented to modify a boiler combustion air system.

In the drawings, and referring first to FIG. 1, there is generally shown at 10 a lower portion of a conventional recovery boiler which is of a type that is generally used in pulp mill operations. As a person skilled in the art would know, the boiler 10 has a furnace or combustion chamber 12 in which byproducts of the pulp-making process are burned. This is most often referred to in the art as the "burning bed 14". The inside wall of the combustion chamber 12 is made up of boiler tubes 16 which are used for steam generation purposes.

The boiler illustrated in FIG. 1 includes primary air inputs or air ports generally indicated by arrow 18, secondary air ports generally indicated by arrow 20, and tertiary air ports generally indicated by arrow 22. As was previously explained, some older recovery boilers have primary and secondary ports only.

Surrounding the outside of the combustion chamber 12 at the secondary and tertiary levels are wind boxes 24, 26. These are essentially large ducts of rectangular cross-section. In most conventional recovery boilers, the air ports leading into the combustion chamber at the secondary and tertiary levels are essentially windows between the boiler tubes 16 that allow combustion air inside of the wind box to pass through to the combustion chamber.

Figure 3:
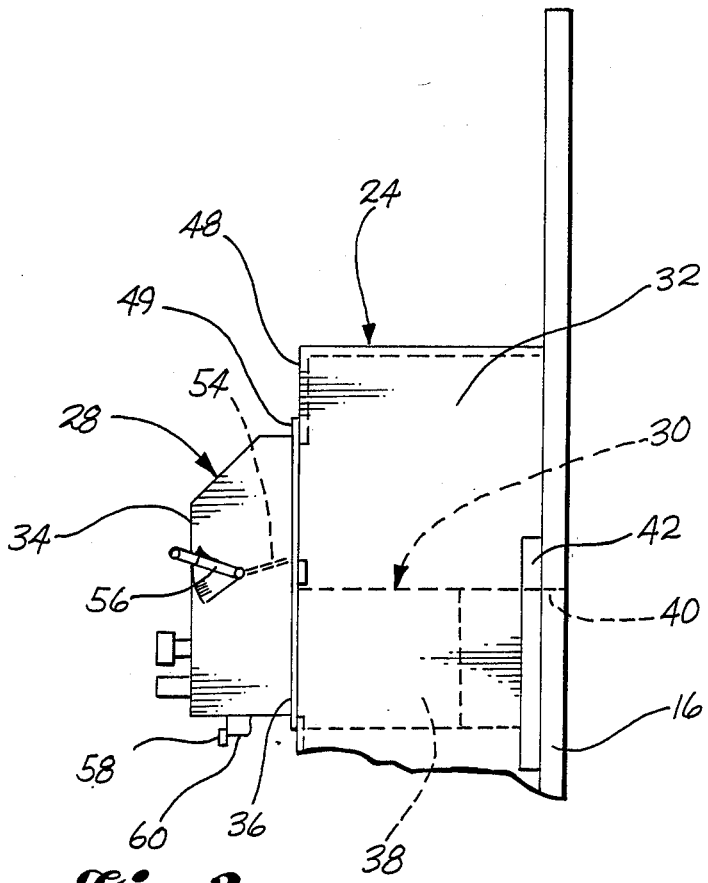
FIG. 3 is an enlarged fragmentary cross-sectional view of one of the wind boxes shown in FIG. 1, with the invention installed.
Figure 4:
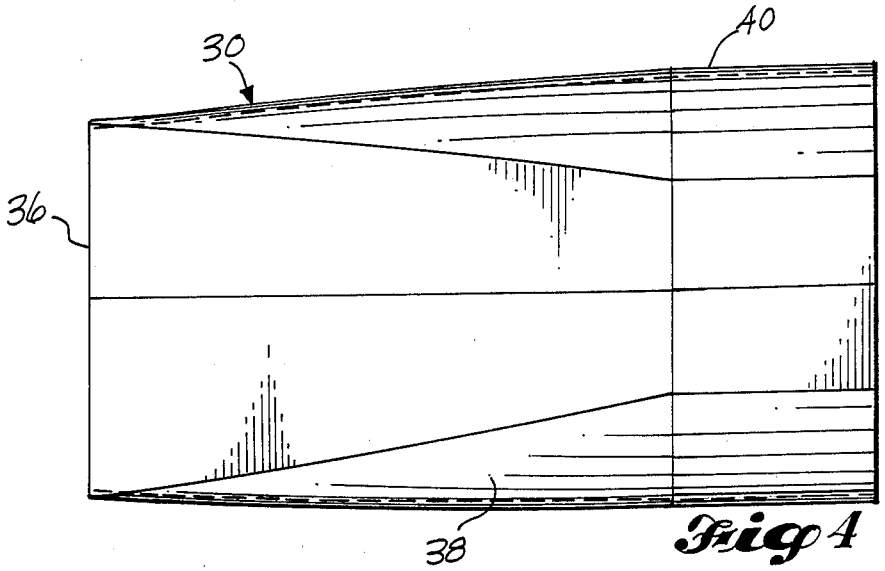
FIG. 4 is a side view of the convergent nozzle shown in FIG. 2.

Reference numeral 28 in FIG. 1 illustrates how the invention may be used to modify air passage from the typical wind box to the combustion chamber of conventional design. As mentioned previously, the typical wind box is a box-like structure of rectangular cross-section that opens directly into the boiler's combustion chamber by means of the air ports in the walls of the chamber. Referring now to FIG. 3, there is shown one preferred embodiment of the invention which includes a nozzle section 30, extending across the inside of the wind box (indicated by reference numeral 32), and a damper section 34 which directs airflow from inside the wind box 32 into the nozzle 30. This configuration will become better understood shortly.

Figure 2:
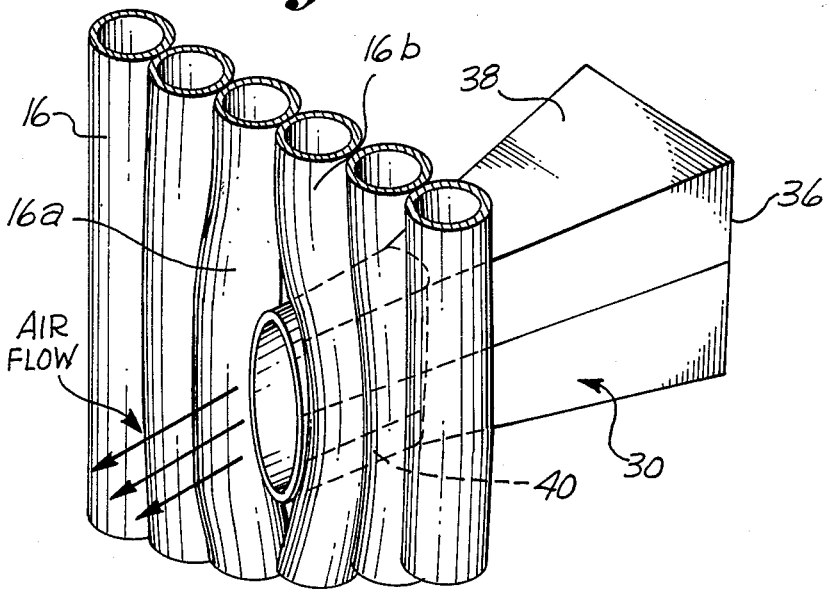
FIG. 2 is an enlarged fragmentary pictorial view of a convergent nozzle in accordance with the invention, and illustrates how the nozzle delivers air into the boiler's combustion chamber.
Figure 5:
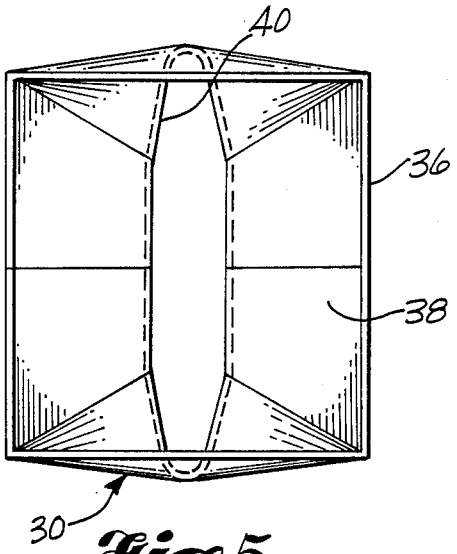
FIG. 5 is an inlet end view of the convergent nozzle shown in FIGS. 2 and 4, looking into its left-hand side.
Figure 6:
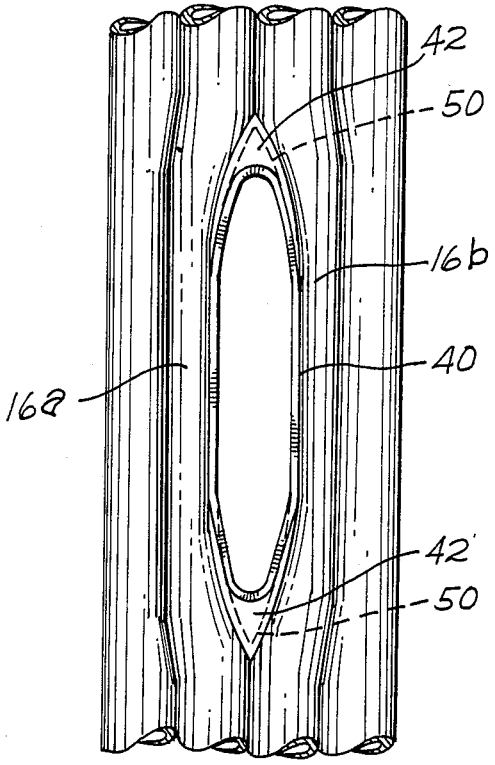
FIG. 6 is an outlet end view of the convergent nozzle shown in FIGS. 2 and 4.

FIGS. 2 and 4–6 illustrate the shape and construction of nozzle 30. Briefly, its inlet end 36 is preferably square or rectangular in cross-section. This is best seen in FIG. 5. The nozzle's convergent walls 38 are best seen in FIG. 2. This portion 38 of the nozzle terminates in an outlet end portion 40 that, when installed, normally extends through an opening or bent tube combustion air port defined by boiler tubes 16*a* and 16*b* in FIG. 6. This opening is indicated by dashed lines 50. The cross-sectional shape of the outlet end 40 is designed to provide a close fit in the bent tube opening 50.

Figure 8:
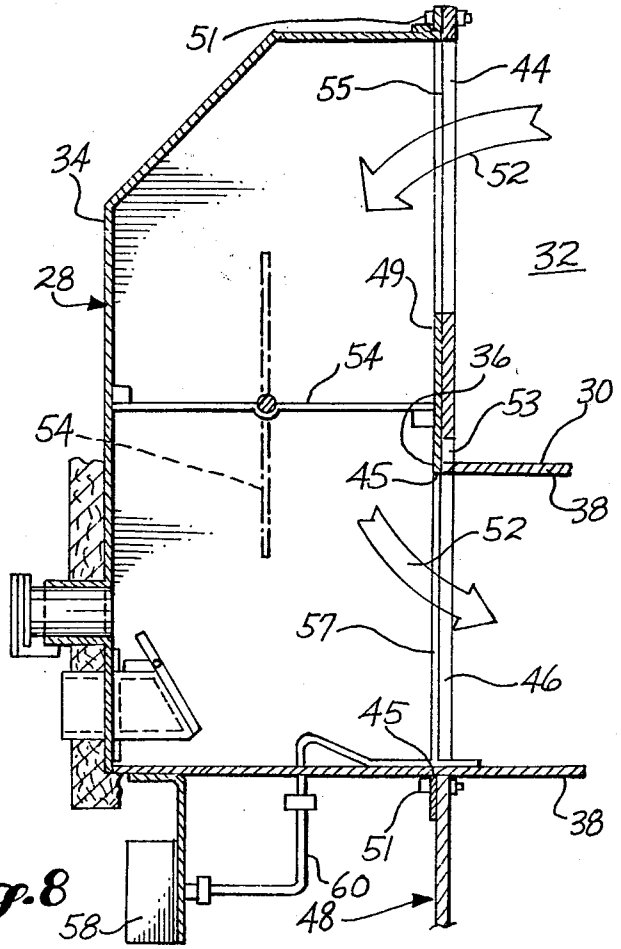
FIG. 8 is an enlarged fragmentary view of the installation shown in FIG. 3, and shows how the damper section connects an existing wind box to the nozzle shown in FIGS. 2 and 4–6.
Figure 7:
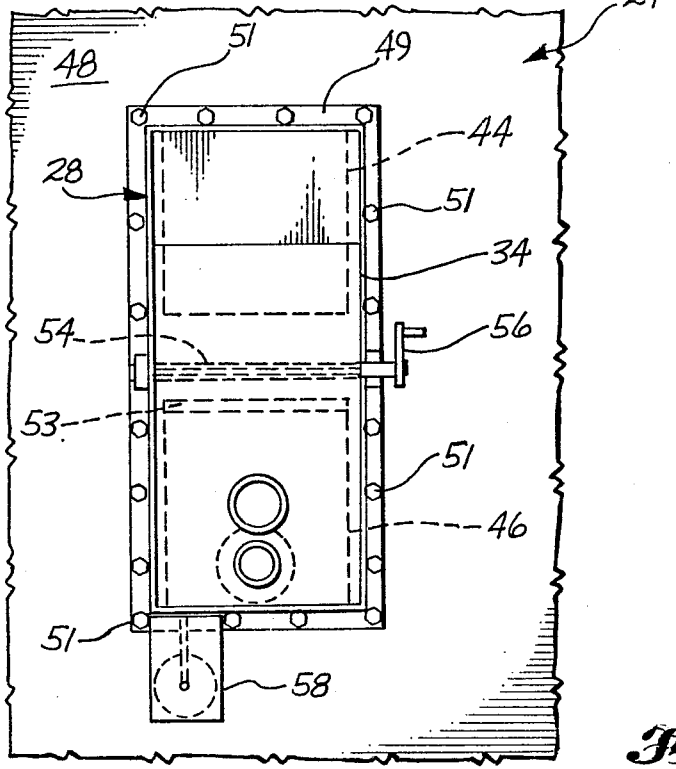
FIG. 7 is a back-side view of a damper section of the invention.
Figure 9:
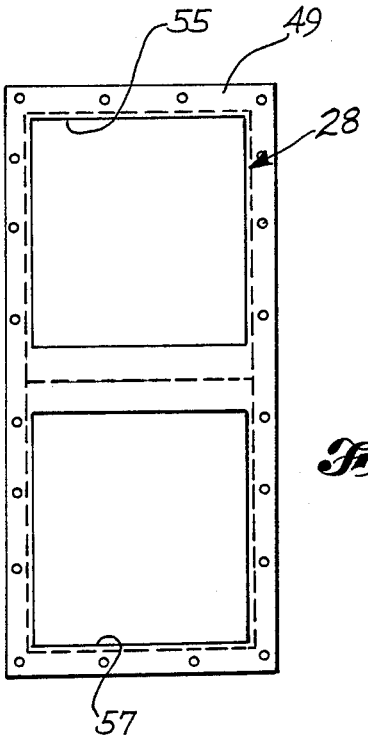
FIG. 9 is a view of a frame which is used to mount the damper section of FIGS. 7 and 8 to a wind box.

In the embodiment shown in FIGS. 7 and 8, the nozzle 30 is installed in the wind box 24 by first making upper and lower cut-outs 44, 46 (see FIG. 7) in the wind box's outer wall 48. The lower cut-out 46 is sized to correspond to the height of the nozzle's outlet end 40 and the approximate cross-section of the nozzle inlet 36. More particularly, and directing attention to the nozzle 30 shown in FIGS. 3–6, the embodiment shown there has an outlet end whose vertical height is actually greater than the inlet end 36. This is a result of the unique convergent design of that particular embodiment. Of course, as a skilled person would know, the height of the nozzle's outlet end relative to its inlet end might vary depending on the particular recovery boiler in which the invention is installed. Therefore, the height of the lower cut-out 46 may be slightly greater than the height of the nozzle 30 at its inlet end.

Figure 10:
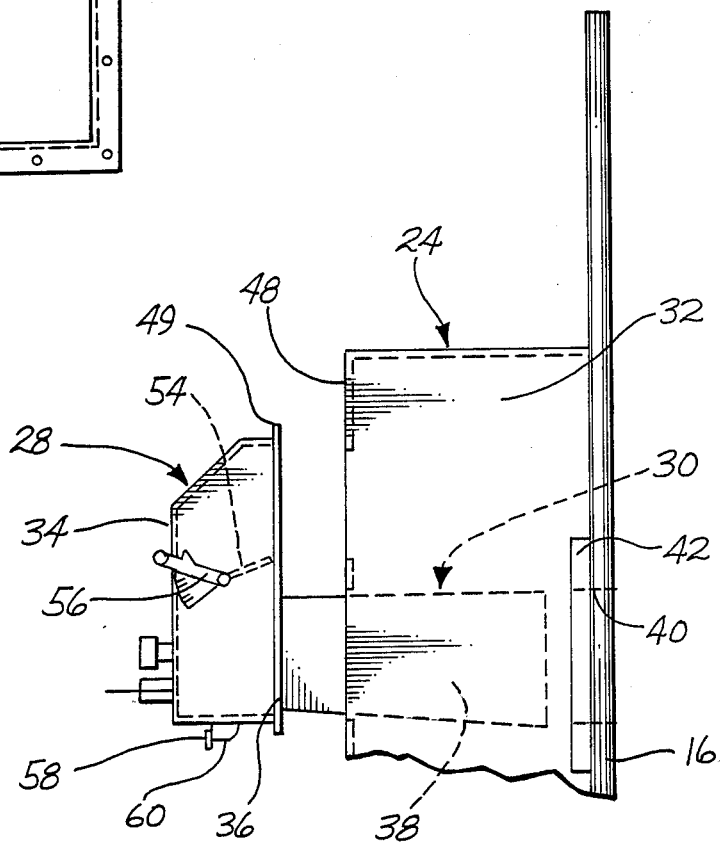
FIG. 10 is a view like FIG. 3, but shows the nozzle and damper section being installed on a wind box.

Prior to installation of nozzle and damper sections 30, 28, the inlet end 36 of the nozzle 30 is welded directly to the damper section as shown at 45 in FIG. 8. The damper section is then welded to a frame 49 having square cut-outs 55, 57. This assembly of nozzle 30, damper section 28 and frame 49 is then bolted, as indicated at 51, over the cut-outs 44, 46 made in the wind box (see FIG. 10). The frame 49 covers the above-discussed slightly greater height of the lower cut-out, which is indicated at 53. Thus, the damper section 34 is placed over both the upper and lower cut-outs 44, 46 and defines an airflow conduit from inside of the wind box to the nozzle 30 by bending pressurized air in the wind box outwardly and around through damper section 34. This is illustrated by arrows 52 in FIG. 8.

The amount of airflow from the wind box into the nozzle 30 may be regulated by a rotatable damper 54. This damper 54 is actuated by a crank arm 56 that is controlled by conventionally known methods. A conventionally known pressure gauge and tube 58, 60 may be provided to monitor the pressure in the damper section 34 and nozzle 30.

Figure 11:
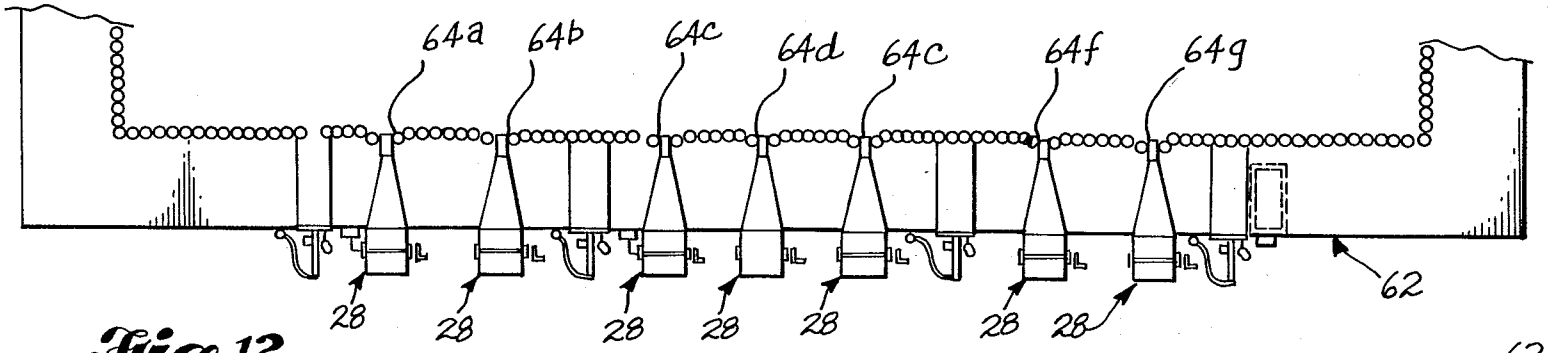
FIG. 11 is a top plan view of a conventional recovery boiler wind box and shows how the invention disclosed herein is used to modify this type of wind box.
Figure 12:
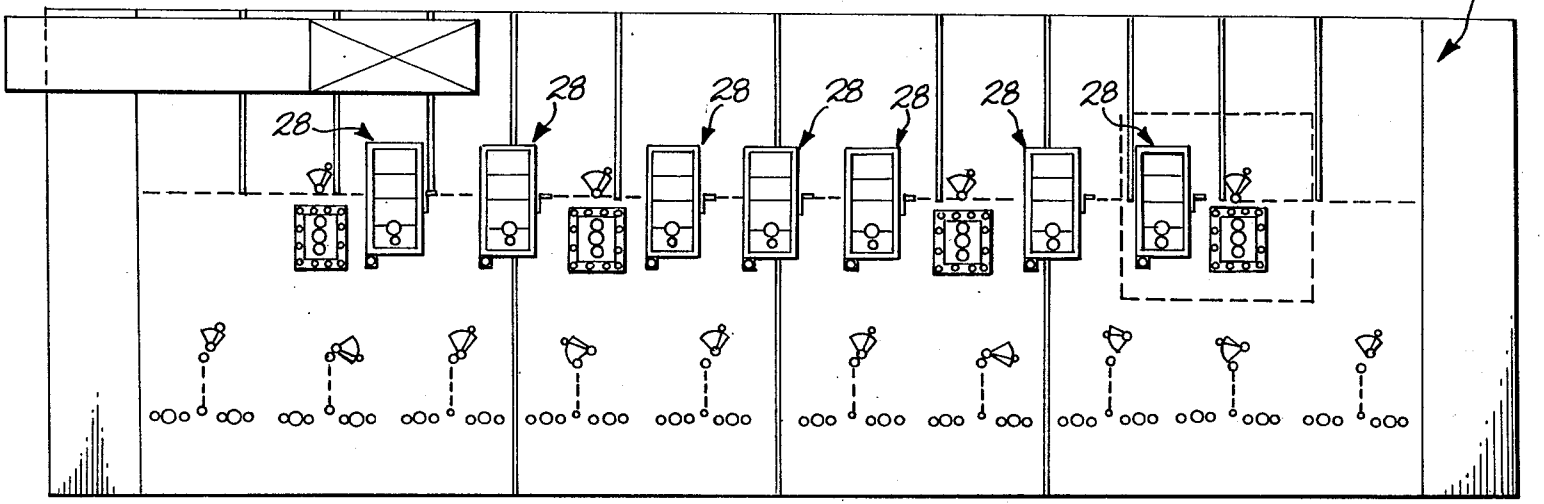
FIG. 12 is an elevational view of the wind box shown in FIG. 11.

The convergent portion or walls 38 of the nozzle 30 accelerates the airflow leaving the damper section 34 and creates a jet of air having sufficient kinetic energy and momentum to penetrate the flue gases above the boiler's burning bed 14. FIGS. 11 and 12 provide an illustrative example of a boiler's wind box, which is indicated generally by reference numeral 62. This wind box 62 would be the equivalent of one of the two wind boxes 24, 26 shown in FIG. 1.

It is intended that the invention disclosed herein would be used to modify conventional air ports 64*a*–64*g* by making a separate nozzle 30 and damper section 34 installation of the type previously described at each port. Therefore, referring to FIG. 13 for example, which schematically illustrates a combustion air supply system for a recovery boiler's wind boxes, it is apparent that utilization of the invention creates a system of jetted, high velocity airflow which surrounds and is directed at the center of the combustion chamber.

Figure 13:
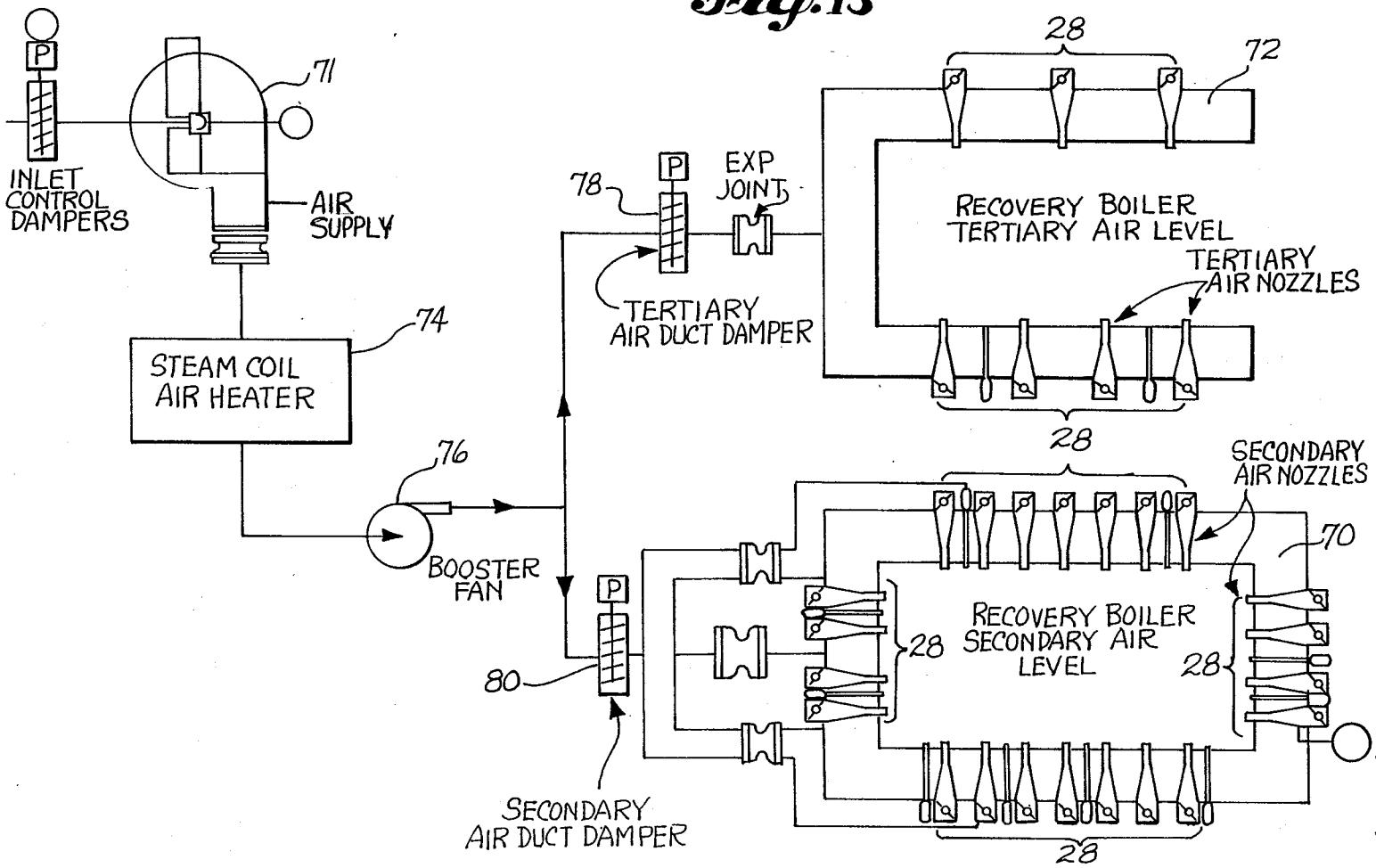
FIG. 13 is a schematic view illustrating a recovery boiler combustion air system, and further illustrates how the invention is implemented in connection with tertiary and secondary wind boxes.

Most conventional recovery boilers utilize a tertiary/secondary air fan, schematically indicated at 71 in FIG. 13, which pressurizes these respective wind boxes 70, 72. The air from this fan 71 is first fed through a steam coil air heater 74 prior to delivery to the wind boxes 70, 72. In order to further improve the performance of the nozzle and damper section installations 28, it may be desirable to employ a booster fan 76 between fan 71 and wind boxes 70, 72. This further pressurizes air delivered to the wind boxes. Conventionally known dampers 78, 80 may be employed to control air from fan 76 into the wind boxes 70, 72.

Figure 14:
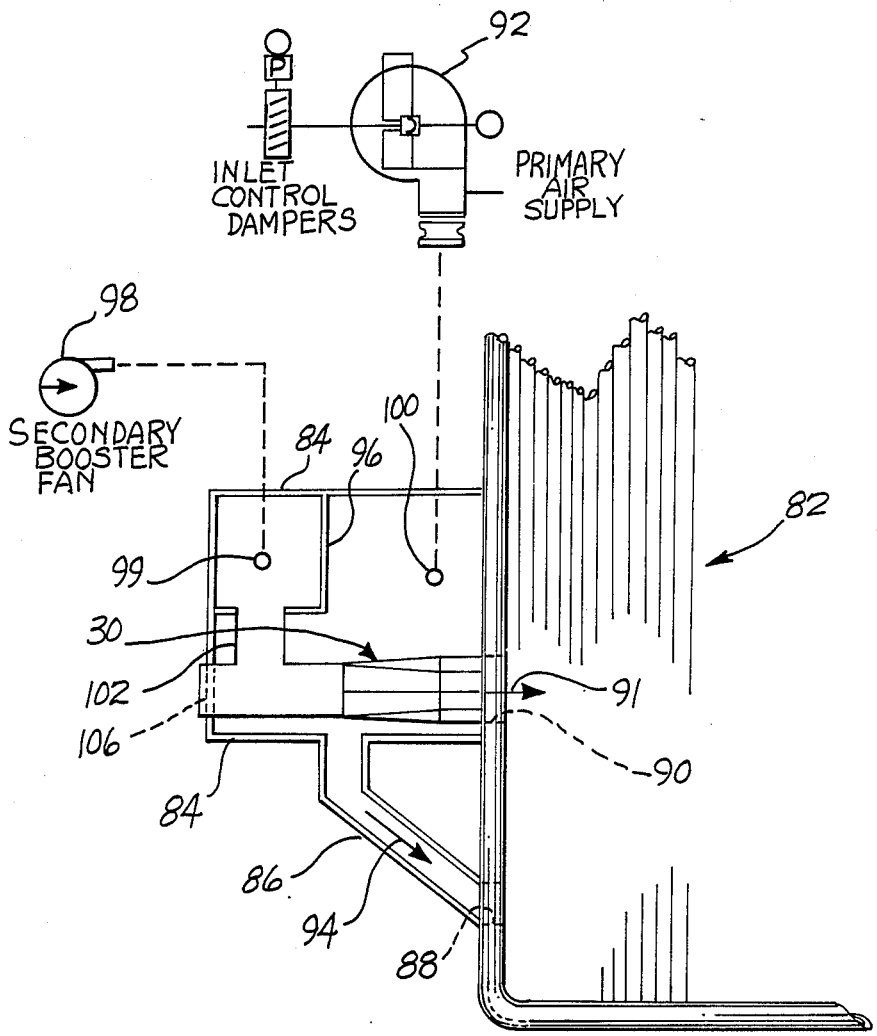
FIG. 14 is a fragmentary cross-sectional view of the lower position of a different configuration of recovery boiler, and shows a portion of the boiler's furnace and a wind box, and how a second embodiment of the invention is implemented to modify this boiler's combustion air system.
Figure 15:
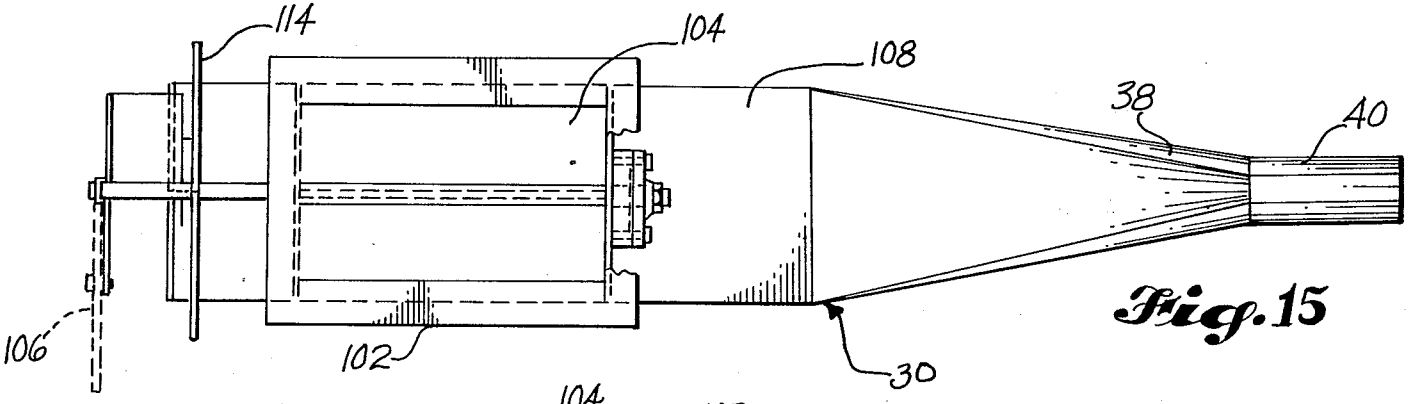
FIG. 15 is a top view of a second nozzle embodiment.
Figure 16:
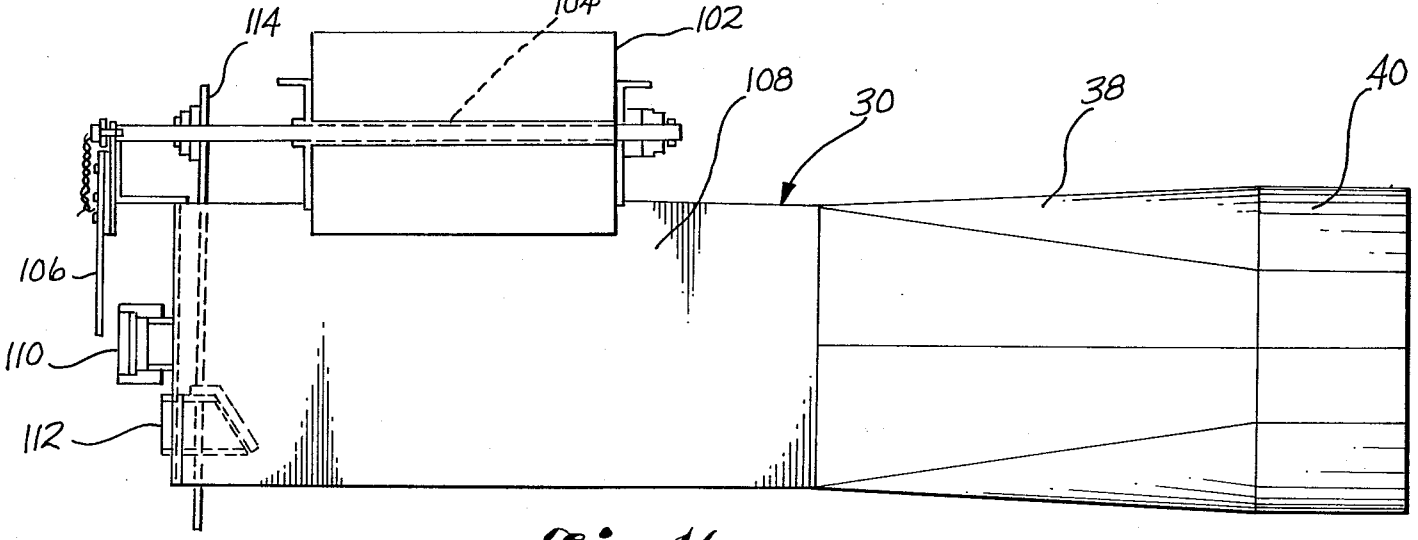
FIG. 16 is a side view of the nozzle embodiment shown in FIG. 15.

Referring now to FIGS. 14–16, therein is shown a second preferred embodiment of the invention which is adapted for upgrading another type of recovery boiler. Referring first to FIG. 14, a different form of boiler 82 is schematically shown therein having a wind box 84 that, like the wind boxes 70, 72 shown in FIG. 13, is positioned in surrounding relationship relative to the boiler's furnace. Leading downwardly from the lower side of wind box 84 is a primary air duct 86 which delivers air from the box into the boiler's furnace through primary air port 88.

As would be understood by the skilled person, the wind box 84 normally has a plurality of primary air ducts like duct 86, which feed a plurality of primary air ports leading into the furnace. Unlike the wind boxes previously described, however, the wind box 84 in its original installation does not have ports at a level above the primary ports 88 for the purpose of feeding air directly from inside the wind box 84 into the furnace. During normal operations, air is fed into wind box 84 by a primary air supply fan 92. This air is then fed through primary air duct 86 only, as indicated by arrow 94.

The second embodiment of the invention is designed for modifying the above-described type of wind box configuration or installation. First, the pre-existing or original wind box 84 is modified by constructing a secondary wind box 96 within the confines of the original. This secondary wind box 96 is operatively connected to a secondary booster fan 98, which is somewhat similar to the booster fan 76 shown in FIG. 13. The secondary booster fan 98 pressurizes the inside 99 of secondary wind box 96 to a level which is normally higher than the pressure inside the remaining unmodified space 100 of the original wind box 84.

Like the embodiment shown in FIGS. 1–13, the second embodiment shown in FIGS. 14–16 also utilizes a convergent nozzle 30. The second embodiment 30, however, is connected only to the secondary wind box, and is connected by an internal damper section 102. This is seen better in FIGS. 15 and 16. The end section 40 of the nozzle 30 is installed through a port 90 that is made through the side of wind box 84 and the wall of the furnace. This installation is similar to the nozzle installation shown in FIGS. 2 and 6.

The internal damper section 102, like the damper section 28 shown in FIGS. 1–13, has a rotatable damper 104 controlled by a crank arm 106. This enables airflow adjustment from the secondary wind box 96 into the nozzle 30. Preferably, the nozzle 30 is installed through a suitably sized cut-out 106 (see FIG. 14) and has a rectangularly-shaped or box-like back section 108 that protrudes rearwardly through the wind box. This provides clean-out access via port 112, and observation via port 110. The approximate location of the wind box wall is indicated at 114 in FIGS. 15 and 16.

Like the embodiment shown in FIGS. 1–13, the nozzle 30 shown in FIGS. 14–16 has convergent walls 38 which increase the momentum and consequently penetrating action of the airflow as it is fed from the secondary booster fan 98 through the nozzle 30 and into the furnace or combustion chamber.

As mentioned previously, improvements in pulp mill output have resulted in pulp mill recovery boilers being pushed beyond their current combustion capacity. In other words, recovery boilers cannot process materials at the same rate as they are output from the pulp-making process. In an attempt to keep up, mill operators consequently push the limit of the boilers. When this happens, the boiler's conventional combustion system fails to properly mix combustion air with the fuel. Not only does this result in inefficient combustion, but it also creates rapid fouling due to excessive carry-over of char and smelt, and requires frequent shutdown of the boiler for cleaning. Shutdown of the boiler also dictates shutdown of the pulp mill which is, of course, undesirable.

Generally, boilers of the type shown in FIG. 1 as originally designed will output combustion air from their wind boxes at pressures in the range of 6 to 8 inches of $H_2O$ gauge. In other words, air exiting primary, secondary ports, etc. is within this pressure range. Utilization of the invention significantly increases the pressure of this air. It is known, for example, that the invention can provide combustion air in the range of 14 to 16 inches of $H_2O$ gauge. Boilers of the type shown in FIG. 14 as originally constructed have been known to output combustion air 94 in the range of 3 to 4 inches of $H_2O$ gauge. With the upgrade shown in FIG. 14, combustion air pressure through port 90, as indicated by arrow 91, can be delivered into the furnace at pressures as high as 15 to 20 inches $H_2O$ gauge.

The booster fans 76, 98 (see FIGS. 13 and 14) previously described, help increase the quantity and/or flow rate of the combustion air. The convergent nozzle designs described above, in combination with the booster fans, significantly increase air pressure and consequently penetrating force into the furnace. Further, locating the nozzles in surrounding relationship relative to the boiler's furnace, whether it be for the type of boiler shown in FIG. 1 or FIG. 14, significantly enhances and optimizes air penetration.

Utilization of the present, invention creates significant turbulence over the burning bed because air penetration from the wind boxes is optimized. This makes the combustion of materials in the bed more efficient and allows more solids to be processed without creating fouling conditions. The net result is that boiler capacity is increased and a boiler upgraded by the invention can be kept on-line for extended periods of time without shutdown.

Thus, having read the preceding description, it should be apparent that the invention could be modified from the embodiment disclosed herein without departing from the spirit and scope of the invention. The invention resides in a unique nozzle apparatus that can be used to upgrade boiler combustion air systems with minimum cost, and further, it provides a method of increasing air penetration into the boiler's combustion chamber by providing convergent nozzles which surround the chamber.

It should be appreciated from FIG. 13 that some wind boxes surround a combustion chamber in the sense that the wind box completely encircles it. This is illustrated by the secondary air wind box 70. Sometimes this wind box is referred to as the "overbed" wind box since it is positioned at a level that is immediately above the normal height of the burning bed 14. The tertiary wind box 72 has a horseshoe configuration and therefore does not completely encircle the boiler. Nevertheless, it sufficiently surrounds the combustion chamber so that jetted air is provided from two opposing sides which creates significant turbulent mixing in the boiler's flue gases. When the word "surrounded" or "substantially surrounded" is used in the preceding description or following claims, it should be taken to mean either type of wind box and functional equivalents thereof. It should be appreciated that it is the patent claims which define the metes and bounds of the invention, and the scope of patent protection is not to be limited by any of the preceding description. Instead, patent protection is to be limited only by the subjoined claim or claims, wherein such claims are to be interpreted in accordance with the well-established doctrines of patent claim interpretation.

What is claimed is:

1. For use in connection with a recovery boiler having a combustion chamber and at least one wind box positioned in surrounding relationship relative to said combustion chamber, an apparatus for improving the delivery of airflow from said wind box into said combustion chamber, said apparatus comprising:

a nozzle extending through said wind box and having a convergent portion; and a damper section positioned outside of said wind box, said damper section defining an airflow path from inside said wind box into said nozzle, wherein said nozzle interconnects said damper section and a port leading into said combustion chamber, said convergent portion of said nozzle accelerating the airflow delivered into said chamber.

2. The apparatus of claim 1, wherein said damper section includes a rotatable air baffle positioned in said damper section for adjusting the quantity of airflow through said damper section.

3. For use in connection with a recovery boiler having a combustion chamber and at least one wind box positioned in surrounding relationship relative to said combustion chamber, an apparatus for improving the delivery of airflow into said combustion chamber, said apparatus comprising:

a nozzle extending through said wind box, said nozzle being in airflow communication with a port leading into said combustion chamber, and having a convergent portion;

a secondary wind box received within said at least one wind box; and an internal damper section positioned inside said at least one wind box, and defining an airflow path from said secondary wind box into said nozzle.

4. The apparatus of claim 3, wherein said damper section includes a rotatable air baffle positioned in said damper section for adjusting the quantity of airflow through said damper section.

5. The apparatus of claim 3, wherein a primary fan normally supplies an airflow to said at least one wind box, and said airflow is further delivered to at least one other port leading into said combustion chamber, said at least one other port being positioned below said port that is in airflow communication with said nozzle, and wherein said secondary wind box receives an airflow from a secondary fan, and delivers said secondary fan's airflow through said internal damper section and into said nozzle, said nozzle further delivering such airflow through said port in airflow communication with said nozzle and into said combustion chamber.

6. The apparatus of claim 5, wherein said secondary fan delivers an airflow into said secondary wind box at a pressure that is greater than the pressure of the airflow supplied by said primary fan to said at least one wind box.

7. A method of upgrading the combustion efficiency of a recovery boiler, the boiler having a combustion chamber in which a bed of combustibles burns and creates furnace gases which exit upwardly through said chamber, said combustion chamber being substantially surrounded by at least one wind box, and a plurality of air ports normally provide airflow pathways from inside said window box leading into said combustion chamber, at least some of said ports being overbed ports positioned at a level that is normally above said bed, and a primary fan normally supplies pressurized air into said wind box for further communication through said air ports into said combustion chamber, the method comprising:

installing a separate convergent nozzle at substantially each of said overbed air ports, wherein each nozzle is received within said wind box and combustion air is delivered from each nozzle through its respective overbed air port and into said combustion chamber;

using a secondary fan to increase the pressure of said combustion air delivered through said overhead air ports by said nozzles, to a pressure that is normally higher than the pressure of air supplied by said primary air fan into said wind box, thereby deliveirng into said combustion chamber an airflow having sufficient penetrating force to create turbulent mixing of said gases above said bed of combustibles.

8. The method of claim 7, further comprising:

installing a plurality of damper sections, one damper section installation for each convergent nozzle installation, wherein each damper section is mounted on an outer sidewall of said at least one wind box, said damper sections communicating pressurized air from inside said wind box to each damper section's respective convergent nozzle; and positioning said secondary fan in intermediate relationship relative to said primary fan and said at least one wind box, said secondary fan boosting the air pressure supplied from said primary fan into said at least one wind box.

9. The method of claim 7, further comprising:

installing a secondary wind box inside said at least one wind box;

operatively connecting said secondary fan to said secondary wind box, in a manner so that said secondary fan delivers high pressure air into said secondary wind box;

installing a plurality of damper sections, one damper section installation for each convergent nozzle installation, wherein each damper section is received within said at least one wind box; and using said internal damper sections to connect said convergent nozzles to said secondary wind box.

10. A method of upgrading the combustion efficiency of a recovery boiler, the recovery boiler having a combustion chamber in which a bed of combustibles burns and creates furnace gases that exit upwardly through said chamber, and a plurality of air ports through the wall of said chamber, at least some of which are overbed air ports distributed substantially around said chamber at a level that is normally above said bed of combustibles, the method comprising:

installing a plurality of nozzles substantially around said chamber, each nozzle being in airflow communication with a single one of said overbed air ports, and each nozzle having a convergent portion whose geometry is fixed and nonvariable; and providing pressurized combustion air through said air nozzle, wherein each nozzle delivers said combustion air through its respective air port into said combustion chamber, and wherein said convergent portion of each nozzle converges along the line of entry of said combustion air into said chamber, and delivers said air with sufficient penetrating force so that said nozzles cooperatively create turbulent mixing of said furnace gases above said bed of combustibles.

* * * * *

UNITED STATES PATENT AND TRADEMARK OFFICE

CERTIFICATE OF CORRECTION

PATENT NO. : 4,940,004

DATED : July 10, 1990

INVENTOR(S) : Johan H. Jansen

It is certified that error appears in the above-identified patent and that said Letters Patent is hereby corrected as shown below:

Column 2, line 39, "level" should be -- levels --.

Column 3, line 42, insert a period after "benefits".

Column 7, line 52, delete the comma after "present".

Column 8, line 18, "It should" begins a new paragraph.

Claim 7, column 9, line 24, "window" should be -- wind --.

Claim 7, column 9, line 38, "overhead" should be - overbed -.

Claim 7, column 9, lines 41 and 42, "deliveirng" should be -- delivering --.

Signed and Sealed this

Nineteenth Day of November, 1991

*Attest:*

*Attesting Officer*

HARRY F. MANBECK, JR.

*Commissioner of Patents and Trademarks*